US006540874B1

(12) United States Patent
Ling-Chen

(10) Patent No.: US 6,540,874 B1
(45) Date of Patent: Apr. 1, 2003

(54) ASPHALT-GRADE CARBON FIBER PAPER AND ITS PROCESS

(76) Inventor: Ruey Ling-Chen, No. 59, Yng Shiuh 2 nd St., Yangmei City, Taoyuan (TW)

( * ) Notice: Subject to any disclaimer, the term of this patent is extended or adjusted under 35 U.S.C. 154(b) by 0 days.

(21) Appl. No.: 09/715,108

(22) Filed: Nov. 20, 2000

(51) Int. Cl.[7] ..... D21H 13/50

(52) U.S. Cl. ..... 162/138; 162/146; 162/164.1; 162/165; 162/168.1

(58) Field of Search ..... 162/138, 135, 162/146, 181.9, 157.1, 168.1, 164.1, 165

(56) References Cited

U.S. PATENT DOCUMENTS

| | | | | | |
|---|---|---|---|---|---|
| 3,265,557 | A | * | 8/1966 | DeFries | 162/181.9 |
| 3,367,851 | A | * | 2/1968 | Filreis et al. | 162/138 |
| 3,774,299 | A | * | 11/1973 | Sato et al. | |
| 3,998,689 | A | * | 12/1976 | Kitago et al. | 162/146 |
| 4,645,566 | A | * | 2/1987 | Kato et al. | 162/138 |
| RE34,162 | E | * | 1/1993 | Boyd | 162/138 |

FOREIGN PATENT DOCUMENTS

| | | | | |
|---|---|---|---|---|
| JP | 62-268898 | * | 11/1987 | 162/138 |
| SU | 717204 | * | 2/1980 | 162/138 |

* cited by examiner

*Primary Examiner*—Peter Chin
(74) *Attorney, Agent, or Firm*—Rosenberg, Klein & Lee

(57) ABSTRACT

The present invention herein relates to an asphalt-grade carbon fiber paper comprised primarily of asphalt-grade carbon fibers and paper base material, and its process, where the paper base material may be made of cellulose fibers or synthetic fibers and resin, while the asphalt-grade carbon fiber: paper base material=10~50:50~90% (by weight). The asphalt-grade carbon fibers, with their conductive, antistatic and shielding actions, are incorporated into the paper base material and give it conductive and statics elimination effect. Furthermore, the paper may be processed into products with electrical and thermal conductivity or for packaging. The aforesaid asphalt-grade carbon fiber paper features excellent conductivity, high thermal conversion ratio, long service life and low cost. Its process is also extremely simple and easy to operate.

5 Claims, No Drawings

ASPHALT-GRADE CARBON FIBER PAPER AND ITS PROCESS

BACKGROUND OF THE INVENTION

1) Field of the Invention

The invention herein relates to a kind of asphalt-grade carbon fiber paper and its process, where the paper comprises primarily of asphalt-grade carbon fiber and paper base material. By the asphalt-grade fiber, as used herein, is meant a carbon fiber obtained from carbonization of asphalt. Through the established procedure of cutting, beating, stirring, paper machine, and drying, asphalt-grade carbon fibers and paper base material of fixed mixing ratio are fully and homogeneously blended into one body and form a kind of asphalt-grade carbon fiber paper which incorporates the conductive, antistatic and shielding actions of asphalt-grade carbon fiber and thereby possesses conductive and statitic elimination effect. Furthermore, such paper can be processed into other electric conductive, thermal conductive and packing products.

2) Description of the Prior Art

To prevent the generation and accumulation of statics, charge consuming material is required in the ennvironment. Thus there are a variety of products made of conductive material that can effectively consume electric charges available on the market, of which, a kind of conductive carbon-coated fibers are applied extensively. Such carbon-coated fibers can be made further into all kinds of conductive materials having low resistance. The technology that produces said carbon-coated fiber entails mainly coating a layer of carbon powder on the surface of fibers which are pressed into paper or mixed into a plastic material and made into highly-conductive material. However, given that the carbon powder coated on the surface of fibers is prone to fall off, such deficiency results in products with signficantly compromised conductivity. Furthermore, in order to prevent the carbon powder from falling off, stirring in subsequent processing into conductive material is limited in terms of time and force. Consequently, carbon coating tends to be non-uniformed and affects the quality of the resulting product. In addition, the entire process of carbon coating is also made more complicated.

From the description above, the known techniques of forming and producing conductive carbon-coated fibers have deficiency in practice and room for breakthrough.

SUMMARY OF THE INVENTION

The objective of the invention herein is to provide a simply-made and low cost asphalt-grade carbon fiber paper having superior electrical and thermal conductivity and its process.

The asphalt-grade carbon fiber paper provided herein comprises of primarily asphalt-grade carbon fiber and paper base material with the following compositions and mixing ratio:

Asphalt-grade carbon fiber: paper base material= 10~50:50~90% (by weight), in which, the paper base material consists of cellulose fibers and resin with the following mixing ratio:

Cellulose fibers: resin=80~85:15~20% (by weight).

The aforeaid paper base material may be synthetic fiber as well, such as vinylon fiber, polypropylene fiber, polyethylene fiber and acrylic fiber.

The aforesaid cellulose fiber may be wood pulp fiber, cotton pulp fiber and straw pulp fiber, while the resin may be soluble phenolic resin or phenolic butyl nitrile glue.

The aforesaid asphalt-grade carbon fiber ranges 5~20 $\mu$m in diameter and 3~6 mm in length.

The aforesaid cellulose fiber ranges 5~20 $\mu$m in diameter and 3~6 mm in length.

The aforesaid synthetic fiber ranges 5~20 $\mu$m in diameter and 3~6 mm in length.

The asphalt-grade carbon fiber employed in the present invention has conductive, antistatic and shielding actions, and thus is free of the problem of carbon powder falloff when it is applied in conductive paper and enhances substantially the performance of high-conductivity paper (including improved conductivity and service life). Also, given that the carbon fibers may be thoroughly mixed in the pulp and form an even network, the conductive paper formed will show greatly enhanced conductivity.

Products made of the present invention not only have good conductivity and high thermal conversion ratio, they also have the advantages of fast heat conductance and greater radiation effect. In application, products enjoy longer service life and lower cost.

The process of manufacturing asphalt-grade carbon fiber paper provided in the present invention is also extremely simple that comprises the following steps:

(1) Cutting: cellulose fibers or synthetic fibers are cut into shorter fibers of 3~6 mm;

(2) Beating: Weigh the asphalt-grade carbon fiber and paper base material according to the proportion described above. Pour them into the beater and add in water to bring the pulp concentration to 0.5~0.8% and proceed with beating to render all carbon fibers and paper base material in dissolved and dispersed state; the beating time usually lasts 2~4 hours with temperature controlled at 25~40° C.;

(3) Stirring: Add in rosin in an amount that equals to 0.5~2% of the absolute dry weight of the pulp, and add in polyvinyl alcohol in an amount that equals to 2~6% of the absolute dry weight of the pulp, and then stir thoroughly to achieve homogenous mix;

(4) Paper machine;

(5) Drying and reeling into finsihed product.

The last two steps of drying and reeling are the same as the customary technique of paper making.

BRIEF DESCRIPTION OF THE PREFERRED EMBODIMENT

The present invnetion is further depicted with the illustration of embodiments.

EMBODIMENT 1

Weigh 200 kg of asphalt-grade carbon fiber 5 $\mu$m in diameter and 3~6 mm long; weigh 50 kg of prepared soluble phenolic resin; weigh 750 kg of wood pulp fiber 5 $\mu$m in diamater. Subsequently, proceed with the following steps:

(1) Cutting: cut the wood pulp fibers into shorter fibers 3–6 mm long.

(2) Beating: pour the weighed carbon fiber, wood pulp fiber and soluble phenolic resin into the beater, add 130 tons of water, and then proceed with 3 hours of beating with temperature controlled at 25° C.;

(3) Stirring: add 10 kg of rosin into the aforesaid pulp and add 50 kg of polyvinyl alcohol, then fully stir the mix;

(4) Paper machine;

(5) Drying and reeling (following the customary paper making technique).

The asphalt-grade carbon fiber paper produced thereof is subjected to tests and the following data are obtained:

Resistance: 100 Ω (sample area 200×400 mm)

Exothermic power: 484 W

Basic applicable voltage: 220V/110V (12V, 24V and 36V may be applied to products of secondary processing)

Paper weight: 120 g/$M^2$ wherein the soluble phenolic resin is prepared by reacting phenol amide with formaldehyde in the molar ratio of 2 to 1 under the catalysis of sodium hydroxide or base metal hydroxide.

EMBODIMENT 2

Weigh 400 kg of asphalt-grade carbon fiber 5 $\mu$m in diameter and 6 mm long and 600 kg of vinylon fiber. The working steps are the same as those described in Embodiment 1. The asphalt-grade carbon fiber paper produced thereof is subjected to tests and the following data are obtained:

Resistance: 65 Ω(sample area 200×400 mm)

Exothermic power: 745 W

Basic applicable voltage: 220V/110V (12V, 24V and 36V may be applied to products of secondary processing)

Paper weight: 120 g/$M^2$.

EMBODIMENT 3

Weigh 300 kg of asphalt-grade carbon fiber, 650 kg of wood pulp fiber and 50 kg of phenolic butyl nitrile glue. The working steps are the same as those described in Embodiment 1. The asphalt-grade carbon fiber paper produced thereof is subjected to tests and the following data are obtained:

Resistance: 98 Ω (sample area 200×400 mm)

Exothermic power: 494 W

Basic applicable voltage: 220V/110V (12V, 24V and 36V may be applied to products of secondary processing)

Paperweight: 120 g/$M^2$.

In summary, asphalt-grade carbon fiber paper products made with different mixtures show the following technical indicators:

(1) Under normal atmospheric pressure, the applicable temperature is as follows: for the wood pulp based product up to 130° C.; for the synthetic fiber based product up to 180° C.;

(2) Fiber size=400~600 mm in diameter (no limit in length);

(3) Resistance=50 ~2,500 Ω/20×10 mm;

(4) Paper weight=50 g/$M^2$~120 g/$M^2$;

(5) Exothermic power: 0.1~0.5 W $cm^2$;

(6) Applicable voltage=220V/110V (12V, 24V and 36B may be applied to products of secondary processing).

DETAILED DESCRIPTION OF THE INVENTION

Products made of asphalt-grade carbon fiber paper in the present invention can be effectively applied in other products that desire antistatic property and electric and thermal conductivity.

In fact, when the present invention is employed in practical applications, the process involved is simple, reasonable and highly efficient. Except for compositions and mixing ratios that will remain the same as described above, the manufacturing process for combining the present invention with another article may be moderately adjusted in accordance with the property of said article. Below is an embodiment that combines the present invention with regular drawing.

The compositions, mixing ratios and steps (cutting, beating, stirring and paper machine) for producing the asphalt-grade carbon fiber paper of the present invention are the same as described above. However, the homogeneously mixed, asphalt-grade carbon fiber pulp may be poured into a template in the size of drawing paper that is arranged with two frame-shaped conducting plates (copper plate is acceptable) along the periphery of the drawing paper. The carbon fiber pulp will cover the two conducting plates completely. Subsequently, proceed with drying, and before the pulp is completely dry, cover over it a paper with drawing completed. Through the working of well-mixed resin in the carbon fiber paper that is highly adhesive, the drawing paper is directly, neatly and securely adhered to the surface of carbon fiber paper and forms into one body. Subsequently, subject the carbon fiber paper and the drawing paper in one piece to drying, trimming and framing, and connect power lines to the conducting plates to produce a decorative heater panel that can be used as an ornament and warm up the air.

The carbon fibers contained in the present invention are fully blended in the pulp to form an uniform network with excellent heat conductivity. The two conducting plates are arranged on the periphery of the drawing paper greatly enhance the area in contact with the carbon fibers. Thus when the heater panel is charged that allows the asphalt-grade carbon fibers to generate heat, the heat energy is conducted rapidly to the entire heater panel through the network pattern. Thus the whole heater panel can dissipate heat uniformly and achieves the purpose and effect of warming up the air.

Because the formation of asphalt-grade carbon fiber paper pertained in the present invention does not require carbon coating, but rather blends carbon fibers thoroughly with paper base material, the heater panel produced thereof does not have to worry about the falloff of carbon powder and is able to enjoy longer service life by providing stable and even heat dissipation.

When the present invention is applied in heater panel, the resulting product is very safe since the temperature on the heater panel surface can be reduced by lowering exothermic power and increasing the area of the heater panel. Under normal circumstances, the heater panel surface temperature is set at 80° C.~90° C., far lower than the burning point (about 250° C.) and self-ignition point (about 450° C.) of the paper.

The heater panel described above provides just one embodiment in the practical application of the present invention. There are a wide variety of other applications to produce conductive and packing products.

What is claimed is:

1. A method for manufacturing asphalt-grade carbon fiber paper, comprising the steps of:

(a) preparing a mixture of asphalt grade carbon fiber and paper base material, said mixture containing 10–50 weight % of said asphalt grade carbon fiber and 50–90 weight % of said paper base material, said paper base material containing 80–85 weight % of paper base fiber and 15–20 weight % of soluble resin;

(b) preparing an aqueous dispersion of said mixture and water in a beater, the content of said mixture in said aqueous dispersion being in the range of 0.5–0.8 weight % of said aqueous dispersion;

(c) beating said aqueous dispersion in a beater for 2–4 hours at a temperature ranging from 25° C. to 40° C.;

(d) adding rosin and polyvinyl alcohol to said aqueous solution in amounts corresponding to 0.5–2 weight % of rosin and 2–6 weight % of polyvinyl alcohol of absolute dry weight of said mixture;

(e) stirring results of step (d) to form a homogeneous slurry;

(f) forming paper sheets from said slurry; and (g) drying and reeling said paper sheets.

2. The method of claim 1, wherein said paper base fiber includes cellulose fibers of 3–6 mm in length and 5–20 $\mu$m in cross-section thereof.

3. The method of claim 1, wherein said paper base fiber includes synthetic fibers of 3–6 mm in length and 5–20 $\mu$m in cross-section thereof.

4. The method of claim 1, wherein said fiber carbon fiber includes asphalt-grade carbon fibers of 3–6 mm in length and 5–20 $\mu$m in cross-section thereof.

5. The method of claim 1, wherein said soluble resin is selected from the group consisting of soluble phenolic resin and phenolic butyl nitrile glue.

* * * * *